United States Patent [19]

Summers

[11] 4,312,446

[45] Jan. 26, 1982

[54] BASKET CARRIER

[75] Inventor: Gus E. Summers, Cincinnati, Ohio

[73] Assignee: The C. W. Zumbiel Company, Cincinnati, Ohio

[21] Appl. No.: 105,535

[22] Filed: Dec. 20, 1979

[51] Int. Cl.[3] ..... B65D 75/00

[52] U.S. Cl. ..... 206/185; 206/198

[58] Field of Search ..... 206/170, 185, 198, 180, 206/175, 162

[56] References Cited

U.S. PATENT DOCUMENTS 3,402,872 9/1968 Forrer ..... 206/170

3,421,684 1/1969 Stout, Sr. et al. ..... 206/170

3,547,310 12/1970 Currie ..... 206/170

*Primary Examiner*—Joseph Man Fu Moy

*Attorney, Agent, or Firm*—Wood, Herron & Evans

[57] ABSTRACT

A basket carrier with plural cells in a single row, the carrier including a novel handle panel structure and a novel automatic floor structure. The novel handle panel structure incorporates a panel system by which a handle panel is positioned in a plane normal to the carrier's side walls when the carrier is erected, and parallel to the carrier's side walls when the carrier is knocked-down. The novel automatic floor structure prevents substantial sagging of the floor when the carrier is erected and loaded.

18 Claims, 8 Drawing Figures

BASKET CARRIER

This invention relates to carriers. More particularly, this invention relates to a carrier of the basket type.

There are, of course, innumerable different carrier structures known to the prior art. Carriers of the type with which this invention is associated are most commonly used in the soft drink industry. Of the various types of carriers used in the soft drink industry, one of the most common types is known in the trade as a basket style carrier. The basket carrier includes opposed side walls, opposed end walls and a floor with partitions interiorly of the walls defining multiple cells. This style carrier commonly includes six or eight cells, the cells being provided in two side-by-side rows of three or four cells each. A handle panel is also provided parallel to and between the two rows to permit easy lifting and carrying of a fully loaded carrier by a consumer. In use, a beverage bottle is positioned within each open-top cell, and is supported within that cell by the carrier's floor. A typical basket type bottle carrier is commonly know as a six bottle carrier, and is used for marketing and carrying six relatively small, e.g., eight or twelve fluid ounce, soft drink bottles.

Recently in the market place, and particularly in the soft drink industry, it has become useful to market large beverage bottles, e.g., quart or liter sized bottles. This swing toward marketing of larger size beverage containers, as opposed to the older style marketing technique of selling small size beverage containers, has resulted in the need for basket carriers of, e.g., two cells only. This for the reason, of course, that the same quantity or more of, e.g., soft drink, may be provided in two large size bottles than is contained in six or eight small size bottles. In connection with such a two cell basket carrier, a handle panel for the carrier must be provided which extends normal to the carrier's side walls, i.e., perpendicular to a plane that includes the axes of the carrier's two cells. This, of course, is contrary to the usual six or eight bottle bakset carrier in which the handle panel extends parallel to, and in between of, the two rows of cells on each side of the carrier. The handle panel structure is required, of course, to provide a handle that permits the carrier to be easily carried by a consumer. Further, it is important in a carrier for large size bottles, which are relatively heavy when filled with beverage compared to the small size bottles, to provide a floor structure which does not significantly sag or droop when the loaded carrier is lifted and carried by a consumer. This is important, of course, so that the carrier does not readily tear or break apart when carried by the consumer.

Therefore, it has been one objective of this invention to provide a novel handle panel structure for a basket style carrier having only a single row of cells, e.g., a two cell carrier. In accord with this objective, and in the preferred two cell carrier of this invention, the handle panel structure includes a center handle panel positioned in a plane normal to a plane that includes the cell axes of the erected carrier's single cell row, i.e., of the carrier's two cells. The handle panel is foldably connected, along one side edge, to one carrier side wall by a first handle connector panel that is generally coplanar with that one side wall and that extends from the handle panel toward one carrier end wall only, there being no handle connector panel that is part of that one side wall and that extends from the handle panel toward the other carrier end wall. The handle panel is foldably connected, along the other side edge, to the other carrier side wall by a second handle connector panel that is generally coplanar with that other side wall and that extends from the handle panel toward the other carrier end wall only, there being no handle connector panel that is part of that other side wall and that extends from the handle panel toward the one end wall. When the carrier is erected, the handle panel and handle connector panels provide a generally square Z-shaped configuration when viewed in top view, i.e., the handle panel connector panels are not opposite one another. The carrier can be easily erected from a knock-down configuration where the handle panel is in the same general plane as the side walls and the handle connector panel since it is foldably connected to those connector panels. This carrier structure permits the blank to be structured so that one handle connector panel is at least partially formed from an upward extension of one side wall panel, so that the other handle connector panel is at least partially formed from an upward extension of the other side wall panel, and so that the handle panel itself is formed from upward extensions of both side wall panels, which extensions all extend upward from the top edges of those side wall panels.

It has been another objective of this invention to provide an improved automatic floor structure for a basket style carrier, which floor structure prevents substantial sagging of the floor when the carrier is erected from a knock-down configuration, and loaded with, e.g., bottles. In preferred form, this floor structure includes a narrow width floor panel extending the length of one side wall to which it is foldably connected, and a wide width floor panel of a width equal to the erected floor width and extending the width of the other side wall to which it is foldably connected. One end wall includes a floor support panel foldably connected thereto, and a glue flap extending from one edge of that panel that is glued onto the narrow width floor panel. The other end wall includes a similar floor support panel foldably connected thereto, and a similar glue flap that is glued onto the wide width floor panel. That floor support panel which is glued to the wide width floor panel is connected by a gusset panel to the narrow width floor panel, the gusset panel being connected by a first fold line to the floor support panel and by a second fold line to the narrow width floor panel. It is this gusset panel which, when the assembled carrier is erected from the collapsed position to the set-up position, cooperates and functions to keep the narrow and wide width floor panels from sagging or drooping when the erected carrier is loaded with, e.g., bottles.

Other objectives and advantages of this invention will be more apparent from the following detailed description taken in conjunction with the drawings in which.

and

Figure 1:
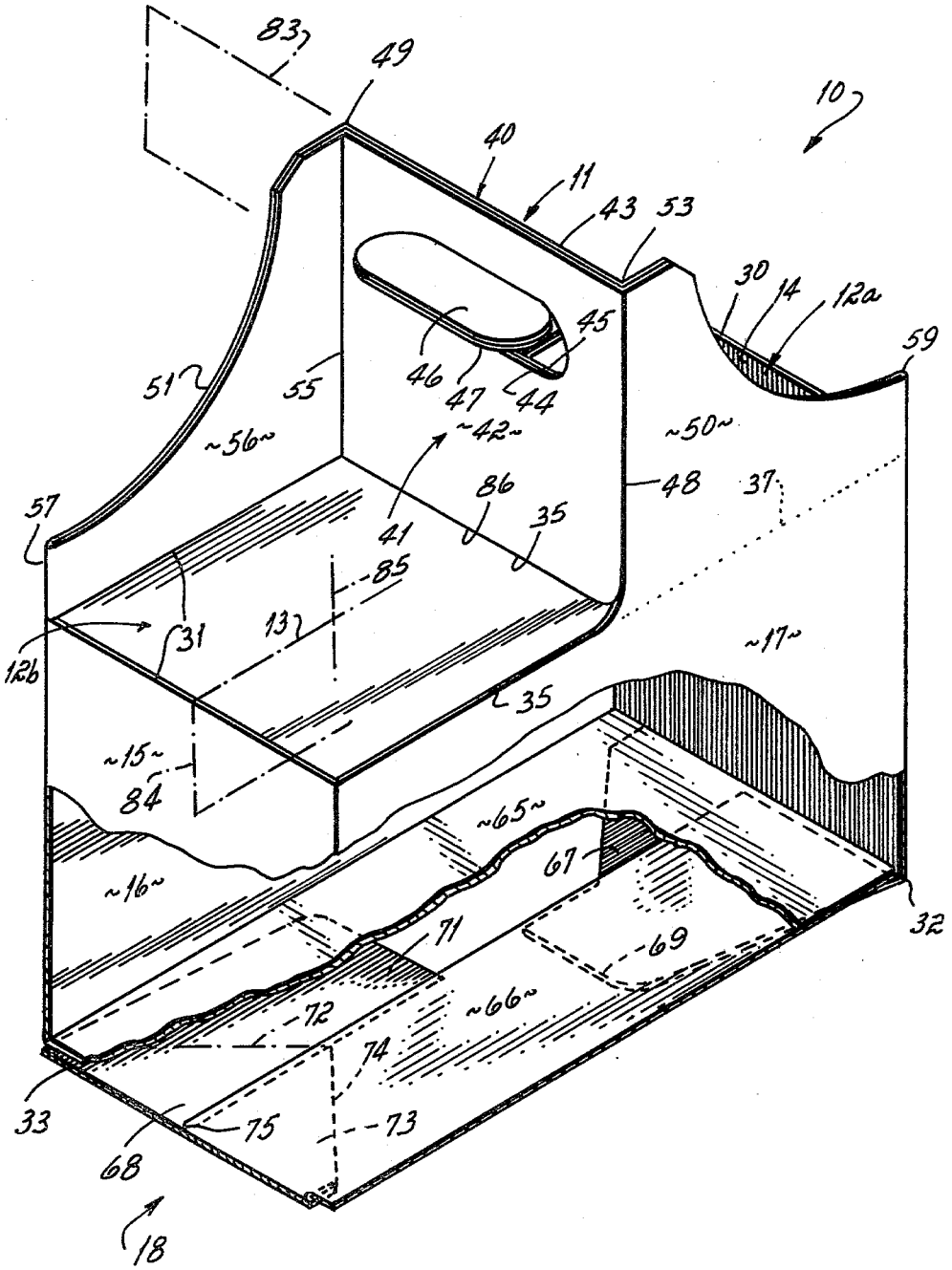
FIG. 1 is a partially cut away perspective view illustrating a two cell basket style carrier fabricated in accord with the principles of this invention.
Figure 7:
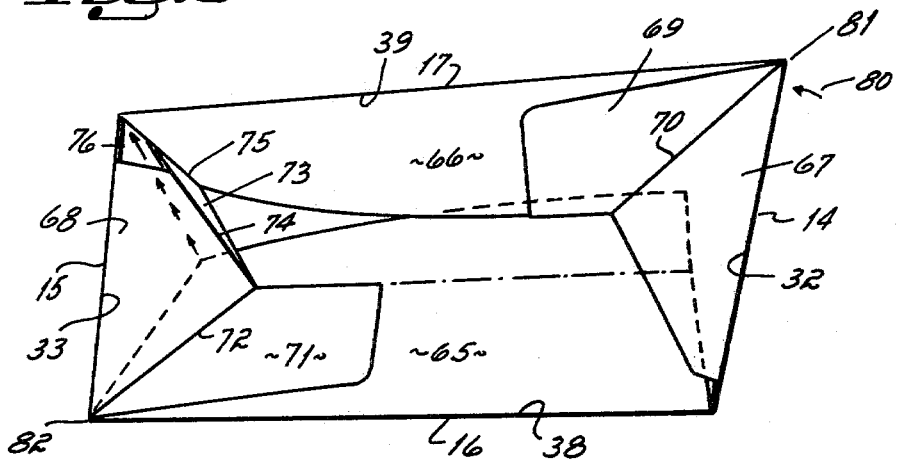
FIG. 7 is a bottom perspective view similar to FIG. 6 illustrating a second step in erection of the carrier's floor.
Figure 8:
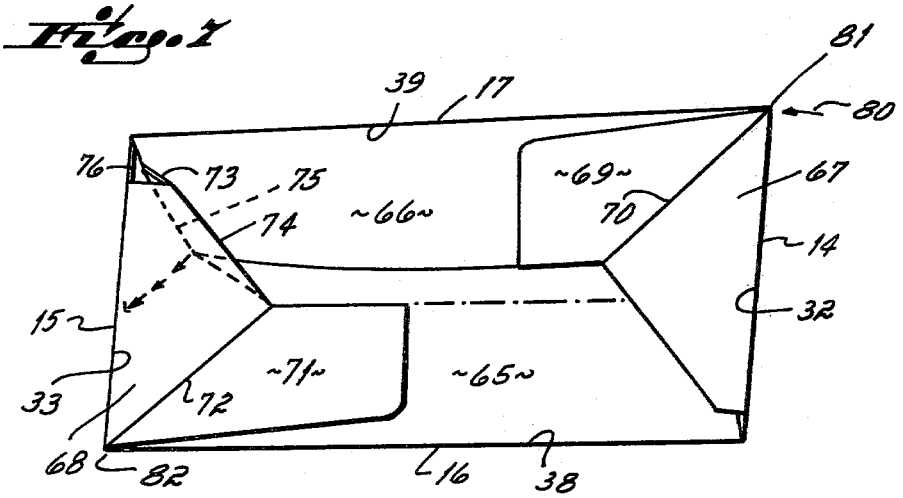

FIG. 8 is a bottom perspective view similar to FIG. 7 illustrating a third step in erection of the carrier's floor, the final erected configuration of the two cell carrier being shown in FIG. 1.

A basket style carrier 10 in accord with the principles of this invention is illustrated particularly in assembled and erected configuration in FIG. 1. The carrier 10 comprises a handle 11 and two open top cells 12, the cells being in a single row 13. The carrier 10 also includes end walls 14, 15, side walls 16, 17, and a floor 18 as is common in basket style carriers.

Figure 2:
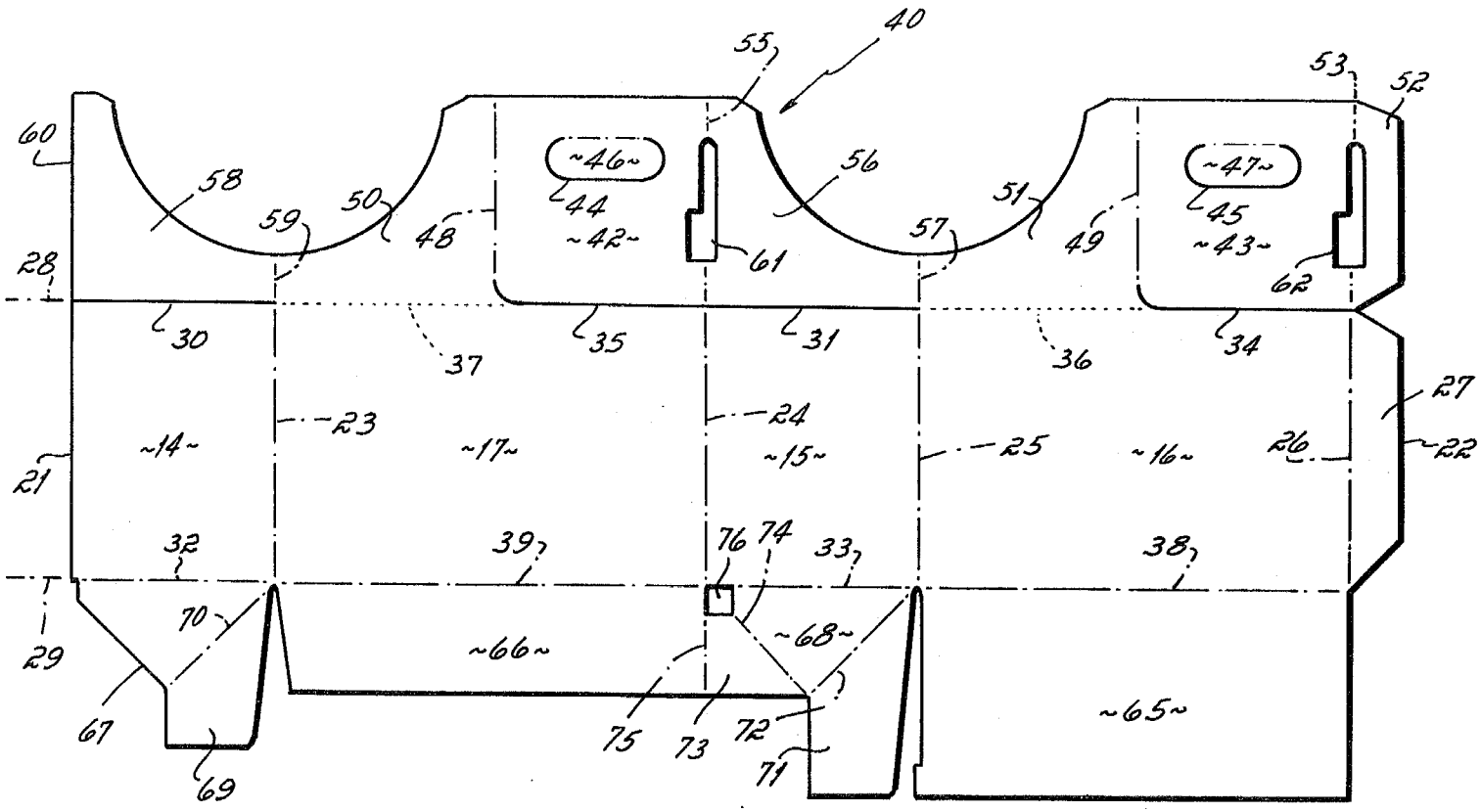
FIG. 2 is a top view illustrating a carrier blank, fabricated in accord with the principles of this invention, for the two cell basket style carrier shown in FIG. 1.
Figure 3:
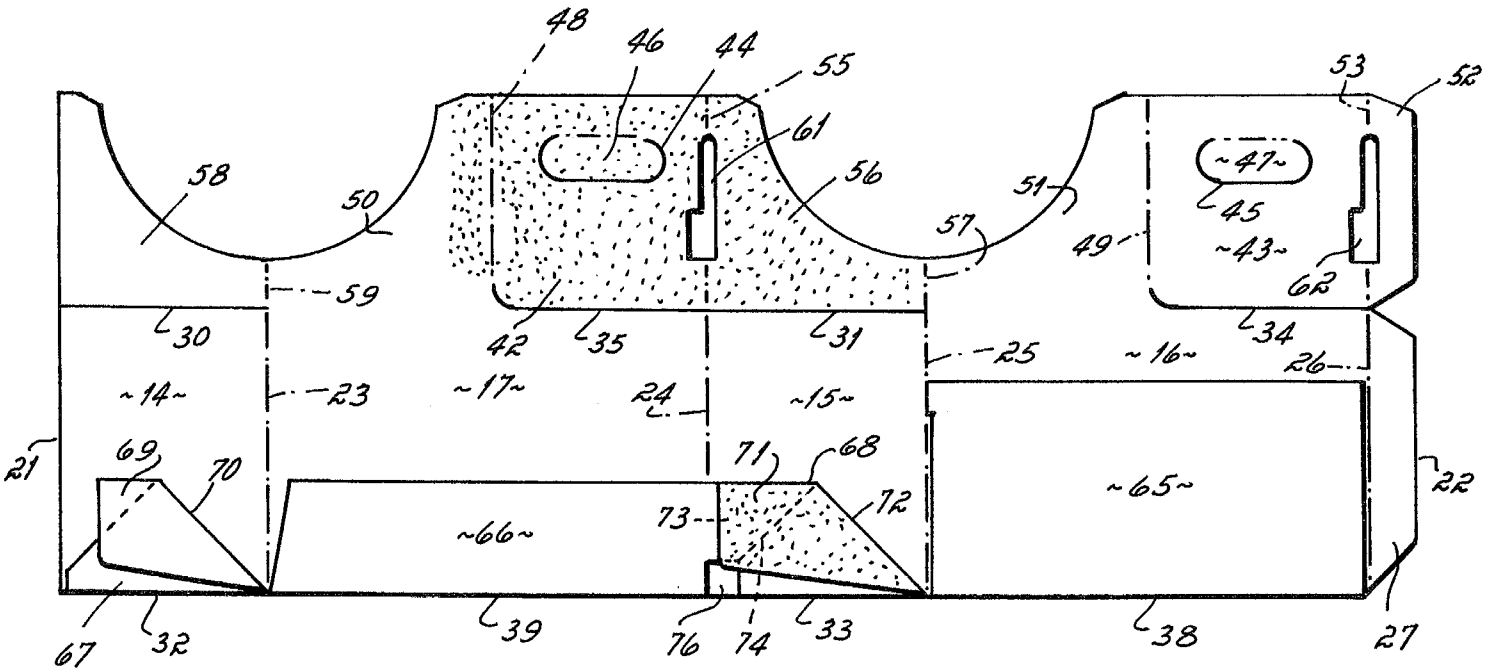
FIG. 3 is a view similar to FIG. 2 but showing a first step in assembly of the carrier blank into the two cell carrier.

The basket style carrier 10 shown in FIG. 1 is fabricated from a carrier blank 20 shown in FIG. 2. The carrier blank 20 is comprised of an end wall panel 14, a side wall panel 17, an end wall panel 15, and a side wall panel 16 in the sequence from one end edge 21 to the other end edge 22 thereof. The first or one end wall panel 14 and the first or one side wall panel 17 are connected by vertical fold line 23, which vertical fold line defines a corner edge of the carrier 10 when erected. The second or other end wall panel 15 and the side wall panels 16, 17 adjacent thereto on either side are separated by vertical fold lines 24, 25, which vertical fold lines also constitute corner edges of the erected carrier, too. The second or other side wall panel 16 is connected along its end edge to glue flap 27 along a vertical fold line 26 that constitutes the fourth corner of the erected carrier. Note that these end 14, 15 and side 16, 17 wall panels are provided with co-extensive linear top edges 28 and co-extensive linear bottom edges 29 which extend from one end 21 to the other end 22 of the carrier blank. In the case of the end wall panels 14, 15, the top edges are defined by cut lines 30, 31, respectively, and the bottom edges are defined by fold lines 32, 33, respectively. In the case of the side wall panels 16, 17, the top edges of each are defined partially by cut lines 34, 35, respectively, and partially by phantom lines 36, 37, respectively, and the bottom edges are defined by fold lines 38, 39.

The various panels in the carrier blank 20 which make up the handle panel structure 40 for the two cell carrier 10 are positioned above, i.e., extend upwardly from, the respective end 14, 15 and side 16, 17 wall panels. In other words, the handle panel structure 40 is comprised of panels which, when in the carrier blank 20 configuration, are all positioned outwardly beyond the top edges 30, 31, 34–37, of the end 14, 15 and side 16, 17 wall panels. The handle panel 41 itself is comprised of first 42 and second 43 handle panels, each of which includes a hand port 44, 45, respectively, and a hand tab 46, 47, respectively, foldable relative thereto. Each of the handle panels 42, 43 is connected on a vertical fold line 48, 49, respectively, to its associated side wall panel 17, 16 through a handle connector panel 50, 51, respectively. Each vertical fold line 48, 49 is parallel to the corner edges 23, 24 and 25, 26 of its respective side wall panel 17, 16, and is disposed substantially midway between those corner edges for each side wall panel. In the case of handle panel 43, same is separated from the top edge 28 of the side wall panel 16 by cut line 34 and is foldably connected to second handle connector panel 51 along one side edge by vertical fold line 49. The handle connector panel 51 with which that second handle panel 43 is associated is, of course, integral and coplanar with the side wall panel 16 and extends upwardly from the phantom top edge 36 portion thereof. The other side edge of that handle panel 43 is provided with a glue flap 52 foldably connected thereto on vertical fold line 53. The first handle panel 42 is foldably connected along vertical fold line 48 to first handle connector panel 50 which is integral with side wall panel 17. This first handle panel 42 is separated from the side wall panel 17 by cut line 35, and is foldably connected on vertical fold line 55 to a supplemental connector panel 56 for the handle connector panel 51. This supplemental connector panel 56 is separated from end wall panel 15 by cut line 31, extends upwardly from that end wall panel 15, and is also foldably connected on vertical fold 57 to handle connector panel 51. Note the vertical fold lines 55, 57 of the supplemental connector panel 56 coincide with corner edge fold lines 24, 25 of end wall panel 15, thereby making the width of the supplemental connector panel 56 the same as the width of the end wall panel 15. A supplemental connector panel 58 also extends above the other end wall panel 14, and is separated therefrom by cut line 30. This supplemental connector panel 58 is foldably connected on vertical fold line 59 to the handle connector panel 50. Note the vertical fold line 59 of the supplemental connector panel coincides with corner edge fold line 23 of the end wall panel 14, thereby making the width of the supplemental connector panel 58 from side edge 60 (which coincides with side edge 21 of end wall panel 14) to fold line 59 the same as the width of the end wall panel 14. Note further that the fold lines 55, 53 are provided with cut-outs 61, 62 along the length thereof to facilitate folding adjacent panels during assembly of the blank 20.

The floor structure 18 of the two cell carrier 10, in blank 20 form, is also illustrated in FIG. 2. The floor structure 18 is comprised of a primary floor panel 65 of a width substantially equal to the width of end wall panels 14, 15, and extending the length of that side wall panel 16 to which it is foldably connected on fold line 38. The floor structure also incorporates a secondary floor panel 66 of a width substantially less than the width of end wall panels 14, 15, extending the length of that side wall panel 17 to which it is foldably connected on fold line 39. In the embodiment shown, the secondary floor panel 66 is about one-half the width of the primary floor panel 65. A triangular floor support panel 67, 68 is foldably connected to respective end wall panels 14, 15 on respective fold lines 32, 33 at the bottom edge 29 of those panels. Triangular floor support panel 67 attached to end wall panel 14 is provided, along one of its edges, with a glue flap 69 foldably connected thereto on fold line 70. Triangular floor support panel 68 attached to end wall panel 15 also is provided along one of its edges, with a glue flap 71 foldably connected thereto on fold line 72. But the floor support panel 68 is also connected to the secondary floor panel 66 by means of a gusset panel 73. This gusset panel 73 is connected along fold line 74 to the floor support panel 68, and is connected along fold line 75 (which is coextensive with the vertical fold line 24 between end wall panel 15 and side wall panel 17) to the secondary floor panel 66. The gusset panel 73 is of significant importance in the automatic floor structure of this invention as is explained in greater detail below. Note that a square hole 76 is cut out in the corner of the gusset panel 73/floor support panel 68 structure to permit easier reverse folding of those panels relative one to another and relative to the secondary floor panel 66 as the carrier blank 20 is assembled into the knock-down configuration, and as the carrier is erected from knock-down to set-up configuration, as explained in greater detail below.

The sequence of folding and gluing the carrier blank 20 (shown in FIG. 2) into an assembled but collapsed carrier 10 (shown in FIG. 5) is illustrated in FIGS. 2–5. Initially, the primary 65 and secondary 66 floor panels, and the triangular floor support panels 67, 68 are all folded from the FIG. 2 position to the FIG. 3 position along the bottom fold edges 38, 39, 32, 33 of the respective side 16, 17 and end 14, 15 wall panels, the glue flaps 69, 71 being simultaneously reverse folded so as to maintain both flaps' inside faces on the exposed face of the blank as shown in the intermediate fold position of FIG. 3. Subsequently, the side wall panel 16, the primary floor panel 65, the handle panel 43 and handle connector panel 51, and glue flaps 27, 52, are all simultaneously folded along vertical fold lines 25, 57 into a second intermediate position shown in FIG. 4. In this second intermediate position, note the two handle panels 42, 43 are glued firmly one to another, and the glue flap 52 foldably connected to handle panel 43 is glued to the handle connector panel 50, for foldably connecting edge 53 of the handle panel 43 to side wall panel 17 (that handle panel 43 being foldably connected to side wall panel 16 on fold line 49). Further, handle connector panel 51 is firmly glued throughout its surface area to supplemental connector panel 56 for foldably connecting edge 55 of the handle panel 42 to side wall panel 16 (that handle panel 42 being foldably connected to side wall panel 17 on fold line 48). Also in this second intermediate fold position the glue flap 71 has been firmly glued to the outside face of the primary floor panel 65, thereby directly connecting the primary floor panel to the secondary floor panel 66 through the triangular floor support panel 68 and the gusset panel 73. In other words, the inside face of the glue flap 71 has been connected to the outside face of the primary floor panel 65 because that glue flap 71 initially was reverse folded against the outside face of the gusset panel 73 and the triangular floor support panel 68.

Figure 4:
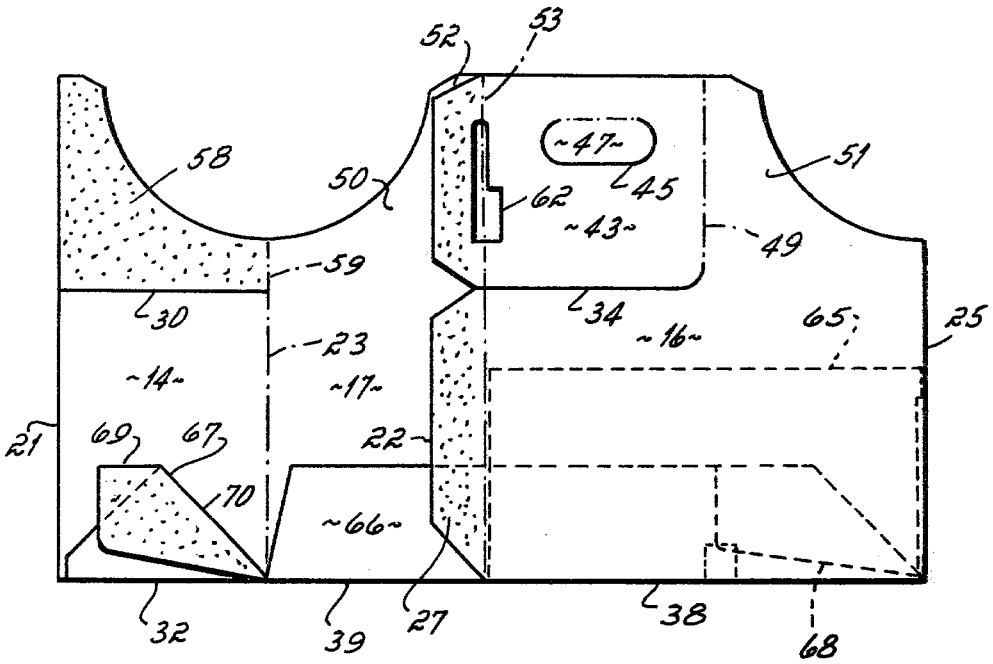
FIG. 4 is a view similar to FIG. 3 showing a second step in assembly of the carrier blank into the two cell carrier.
Figure 5:
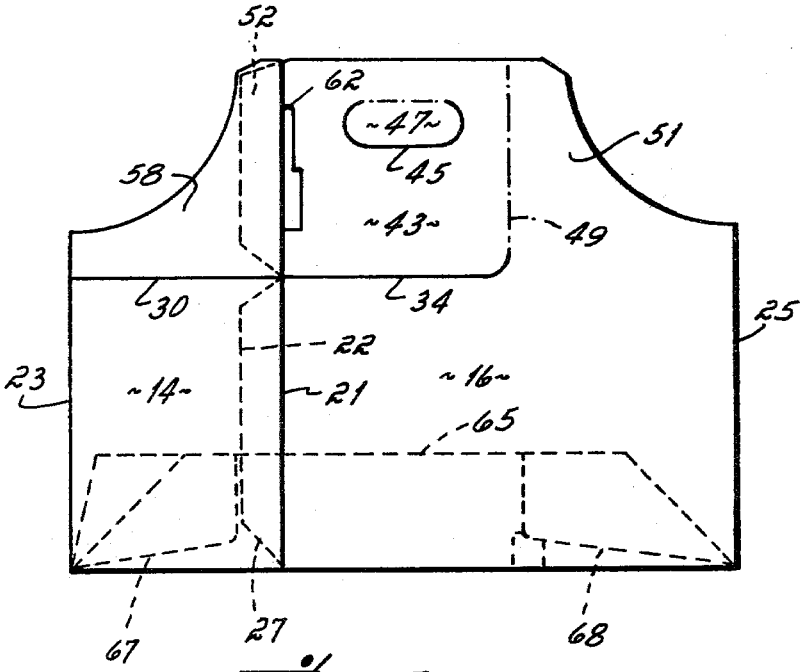
FIG. 5 is a view similar to FIG. 4 showing a completely assembled two cell carrier in accord with the principles of this invention, the carrier being in the flat or knock-down configuration.

Glue is thereafter provided on the FIG. 4 assembly throughout outside face of each of the glue flaps 52, 27 attached to the handle panel 43 and the side wall panel 16, to the inside face of supplemental connector panel 58, and to the inside face of glue flap 69 reverse folded onto triangular floor support panel 67. Subsequently, the end wall panel 14, supplemental connector panel 58 and floor support panel 67 are folded on vertical fold line 23, 59 onto the side wall panel 17 as shown in FIG. 5. In this folded position, the end wall panel 14 is glued to glue flap 27, thereby providing a continuous end wall, side wall closed loop configuration for the carrier 10. Further, the supplemental connector panel 58 is glued throughout its surface area to the handle connector panel 50, that supplemental connector panel also overlying the glue flap 52 and being glued thereto so as to cooperate in providing a reinforced corner fold line 48, 53 for one side edge of the dual handle panels 42, 43. Further, and importantly, the glue flap 69 foldably connected to the triangular floor support panel 67 is glued to the secondary floor panel 66 on the outside face thereof. Thus, the secondary floor panel 66 is connected by glue flap 69 and triangular floor support panel 67 to end wall panel 14, and is connected by gusset panel 73 and triangular floor support panel 68 to end wall panel 15 in the fully glued, i.e., full carrier assembly, configuration shown in FIG. 5.

Figure 6:
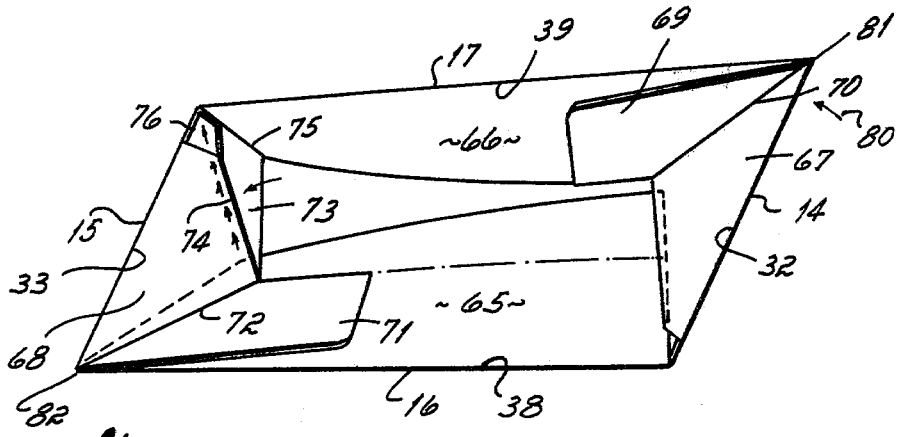
FIG. 6 is a bottom perspective view illustrating a first step in erection of the carrier's floor from knock-down configuration toward erected configuration.

The erection sequence of the fully glued and assembled, but knocked-down, carrier 10 shown in FIG. 5 is illustrated in FIGS. 6–8. In erection of the carrier 10, and with a force exerted in the direction of phantom arrow 80 on corner 81 of the carrier while holding corner 82 of the carrier stationary, the floor support panel 67 and glue flap 69 attached to the secondary floor panel 66 causes it to move from the collapsed attitude into the erect attitude. Simultaneously, the glue flap 71 attached to the primary floor panel 65 which is connected with floor support panel 68 causes the primary floor panel to swing open. This, therefore, provides the automatic floor 18 opening feature of the two cell carrier 10. As the carrier is erected, note particularly that the gusset panel 73 is folded back over the triangular floor support panel 68 along fold line 74 so that it is sandwiched or lies between the floor support panel 68 and the secondary floor panel 66 when the carrier 10 is erected. This gusset panel 73 structural configuration provides a connected support between the primary 65 and secondary 66 floor panels, and between both of those floor panels 65 and 66 and both end walls 14, 15, when the carrier is erected as shown in FIG. 1. And this, in turn, prevents substantial sagging of the carrier's floor 18 when it is erected and filled with, e.g., two heavy quart or liter size beverage bottles.

The erected two cell carrier, as noted, is illustrated particularly in FIG. 1. With respect to the handle panel structure 41 of that carrier 10, note particularly that the center handle panel 42, 43 is of a double paperboard of panel thickness, the handle panel being positioned in a plane 83 normal to a plane 84 that includes the axes 85 of the erected carrier's two cells 12. Note further that the bottom edge 86 of the handle panel 42, 43 does not extend below the top edge 28 of the carrier's end 14, 15 and side 16, 17 walls. The double handle panel 42, 43 is connected, along one side edge 48, to one side wall 17 by a first double thickness connector panel 50, 58 that extends only above the top edge 28 of the side wall 17 portion of the first cell 12*a*, there being no connector panel above the top edge 28 of the side wall 17 portion of the second cell 12*b*. In other words, the handle panel 42, 43 is foldably connected, along one side edge 48, to one carrier side wall 17 by a first handle connector panel 50, 58 that is generally coplanar with that one side wall 17 and that extends from the handle panel toward one carrier end wall 14 only, there being no handle connector panel that is part of that one side wall 17, and that extends from the handle panel toward the other carrier end wall 15. The other side edges 49 of the handle panel 42, 43 is connected to the other side wall 16 by a second double thickness connector panel 51, 56 that extends only above the top edge 28 of the side wall 16 portion of the second cell 12*b*, there being no connector panel above the top edge 28 of the side wall 16 portion of the first cell 12*a*. In other words, the handle panel 42, 43 is foldably connected, along the other side edge 49, to the other carrier side wall 16 by a second handle connector panel 51, 56 that is generally coplanar with that other side wall 16 and that extends from the handle panel 42, 43 toward the other carrier end wall 15 only, there being no handle connector panel that is part of that other side wall 16 and that extends from the handle panel toward the one end wall 14. Thus, the handle panel's connector panels 50, 58 and 51, 56 are not opposite one another, i.e., the handle panel 42, 43 and connector panels 50, 58 and 51, 56 provide a generally square Z-shaped configuration when viewed in top view. This permits the carrier blank 20 to be fabricated with an end wall 14, side wall 17, end wall 15, side wall 16 in-line structure as shown. Also, the carton blank 20 is structured so that each of the handle panel's connector panels 50, 58 and 51, 56 is partially formed from an extension of an end wall panel 14 or 15 and partially formed from an extension of an adjacent side wall panel 16 or 17, and the handle panel itself is formed from extensions of the side wall panels 16, 17, which extensions all extend from one common edge, i.e., the top edge 28, of those end 14, 15 and side 16, 17 wall panels.

When the carrier 10 is erected from the knock-down configuration shown in FIG. 5 to the set-up or carrying configuration shown in FIG. 1, note that the handle panel 42, 43 swings from a position that is generally coplanar with the end 14, 15 and side 16, 17 walls into a perpendicular position relative to those side walls (and, hence, relative to the row plane 84 which includes the cell's axes 85) about vertical fold lines 48, 53 and 49, 55. This is permitted because the bottom edge of the handle panel 42, 43 is separated from the side wall panels 16, 17 by cut lines 34, 35, and because the supplemental connector panels 56, 58 are separated from their respective end wall panels 15, 14 along their bottom edges by cut lines 31, 30.

Having described in detail the preferred embodiment of my invention, what I desire to claim and protect by Letters Patent is:

1. A basket carrier comprising opposed first and second side walls, and opposed first and second end walls, same defining the outside walls of said carrier, a handle panel located generally normal to said side walls when said carrier is set up, a first handle connector panel generally coplanar with said first side wall when said carrier is set up, said first handle connector panel being foldably connected to said handle panel at one side edge thereof, said first handle connector panel extending only from said handle panel toward said first end wall, and a second handle connector panel generally coplanar with said second side wall when said carrier is set up, said second handle connector panel being foldably connected to said handle panel at the other side edge thereof, said second handle connector panel extending only from said handle panel toward said second end wall, said handle panel and both said handle connector panels cooperating to establish a generally square Z-shaped configuration where the handle connector panels are not opposite one another when the set-up carrier is viewed in top view.

2. A basket carrier as set forth in claim 1, said handle panel not extending beneath the top edges of said side walls, and said handle connector panels extending above the top edges of said side walls.

3. A basket carrier as set forth in claim 1, said first and second handle connector panels being integral with said respective first and second side walls, there being no handle connector panel that is part of said first side wall and that extends from said handle panel toward said second end wall, and there being no handle connector panel that is part of said second side wall and that extends from said handle panel toward said first end wall.

4. A basket carrier as set forth in claim 3, said handle panel comprising double panels glued one to the other, one of said double panels being connected by a vertical fold line to said first handle connector panel, and the other of said double panels being connected by a vertical fold line to said second handle connector panel.

5. A basket carrier as set forth in claim 3, each of said handle connector panels comprising double panels glued one to the other, one panel of each double panel pair being connected by a vertical fold line to said handle panel and the other panel of each double panel pair being connected by a vertical fold line to said one connector panel.

6. A basket carrier as set forth in claim 1, said side and end wall panels being foldably connected in-line with one another, one end wall panel being positioned between said side wall panels.

7. A basket carrier as set forth in claim 4, each of said handle connector panels comprising double panels glued one to the other, one panel of each double panel pair being foldably connected by a vertical fold line to said handle panel and the other panel of each double panel pair being connected by a vertical fold line to said one connector panel.

8. A blank for a basket carrier, said carrier blank comprising opposed first and second side walls, and opposed first and second end walls, same defining the outside walls of said carrier, a handle panel located generally normal to said side walls when said carrier blank is assembled and set up, a first handle connector panel generally coplanar with said first side wall when said carrier blank is assembled and set up, said first handle connector panel being foldably connected to said handle panel at one side edge thereof, said first handle connector panel extending only from said handle panel toward said first end wall when said carrier blank is assembled and set up, and a second handle connector panel generally coplanar with said second side wall when said carrier blank is assembled and set up, said second handle connector panel being foldably connected to said handle panel at the other side edge thereof, said second handle connector panel extending only from said handle panel toward said second end wall when said carrier blank is assembled and set up, said handle panel and both said handle connector panels cooperating to establish a generally square Z-shaped configuration where the handle connector panels are not opposite one another when said carrier is assembled, set up, and viewed in top view.

9. A basket carrier blank as set forth in claim 8, said handle panel not extending beneath the top edges of said side walls, and said handle connector panels extending above the top edges of said side walls.

10. A basket carrier blank as set forth in claim 8, said first and second handle connector panels being integral with said respective first and second side walls, there being no handle connector panel that is part of said first side wall and that extends from said handle panel toward said second end wall, and there being no handle connector panel that is part of said second said wall and that extends from said handle panel toward said first end wall.

11. A basket carrier blank as set forth in claim 10, said handle panel comprising double panels adapted to be glued one to the other, one of said double panels being connected by a vertical fold line to said first handle connector panel, and the other of said double panels being connected by a vertical fold line to said second handle connector panel.

12. A basket carrier blank as set forth in claim 10, each of said handle connector panels comprising double panels adapted to be glued one to the other, one panel of each double panel pair being connected by a vertical fold line to said handle panel and the other panel of each double panel pair being connected by a vertical fold line to said one connector panel.

13. A basket carrier blank as set forth in claim 11, each of said handle connector panels comprising double panels adapted to be glued one to the other, one panel of each double panel pair being foldably connected by a vertical fold line to said handle panel and the other panel of each double panel pair being connected by a vertical fold line to said one connector panel.

14. A basket carrier blank as set forth in claim 13, said blank comprising one of said handle panels and one of said handle connector panels being positioned within the vertical end edges of each side wall when said blank is laid out flat, both of said handle panels being foldable on a vertical fold line positioned about half-way between the end edges of a side wall.

15. A basket carrier blank as set forth in claim 14, said blank comprising the other handle connector panel of each handle connector panel pair being positioned within the vertical end edges of an end wall panel, the vertical fold line by which said other handle connector panel of each handle connector panel pair is connected to said one handle connector panel of said handle connector panel pair being coincident with a corner fold line of an adjacent end wall and side wall.

16. A basket carrier blank as set forth in claim 15, said blank comprising both handle panels and one handle connector panel of each of said handle connector panel pairs being separated from a respective and related side wall panel, and from a respective and related end wall panel, by cut lines.

17. A basket carrier blank as set forth in claim 16, said blank having said side walls and said end walls foldably connected one to another along adjacent vertical corner edges.

18. A basket carrier blank as set forth in claim 8, said side and end wall panels being foldably connected in-line with one another, one end wall panel being positioned between said side wall panels.

* * * * *